US009531054B2

(12) United States Patent
Wymant et al.

(10) Patent No.: US 9,531,054 B2
(45) Date of Patent: Dec. 27, 2016

(54) DIRECTIONAL COUPLER

(71) Applicant: Radio Frequency Systems Pty Ltd., Kilsyth (AU)

(72) Inventors: Nicholas P. Wymant, Fitzory (AU); Dieter Pelz, Heathmont (AU); Weijia Chi, Oakleigh East (AU)

(73) Assignee: ALCATEL-LUCENT SHANGHAI BELL CO., LTD., Shanghai (CN)

( * ) Notice: Subject to any disclaimer, the term of this patent is extended or adjusted under 35 U.S.C. 154(b) by 22 days.

(21) Appl. No.: 14/614,939

(22) Filed: Feb. 5, 2015

(65) Prior Publication Data

US 2016/0233569 A1 Aug. 11, 2016

(51) Int. Cl.
*H01P 5/18* (2006.01)
*H01P 3/08* (2006.01)

(52) U.S. Cl.
CPC ..... *H01P 5/184* (2013.01)

(58) Field of Classification Search
CPC ..... H01P 5/16; H01P 5/18; H01P 5/184
USPC ..... 333/109, 110, 111, 112, 116
See application file for complete search history.

(56) References Cited

U.S. PATENT DOCUMENTS 3,723,914 A * 3/1973 Cappucci ..... H03H 7/48 333/112
4,394,630 A * 7/1983 Wayne ..... H01P 5/187 333/116
5,075,646 A * 12/1991 Morse ..... H01P 5/187 333/116
5,521,563 A * 5/1996 Mazzochette ..... H01P 5/187 333/116
5,625,328 A * 4/1997 Coleman, Jr. ..... H01P 5/185 333/116
6,822,532 B2 * 11/2004 Kane ..... H01P 5/187 333/115
7,084,715 B2 * 8/2006 Al-Taei ..... H01P 5/185 333/24 R
7,132,906 B2 * 11/2006 Podell ..... H01P 5/185 333/109
7,623,005 B2 * 11/2009 Johansson ..... H01P 1/2138 333/110
8,044,748 B2 10/2011 Valenti
2012/0194293 A1 * 8/2012 Dupont ..... H01P 5/184 333/109
2015/0303547 A1 * 10/2015 Vaisman ..... H01P 5/10 333/26

OTHER PUBLICATIONS

Thoedore Moreno, "Microwave Transmission Design Data", Dove Publications, 1948, pp. 88-91 and 172-175.

(Continued)

*Primary Examiner* — Dean Takaoka
(74) *Attorney, Agent, or Firm* — Davidson Sheehan LLP

(57) ABSTRACT

A directional coupler includes an outer cavity and first and second striplines deployed within the outer cavity such that transverse electromagnetic (TEM) mode signals are coupled between first portions of the first stripline and the second stripline. The directional coupler also includes first and second electrically and thermally conductive elements connecting the first and second striplines, respectively, to the outer cavity.

18 Claims, 8 Drawing Sheets

(56) References Cited

OTHER PUBLICATIONS

Earl Carpenter, "The Virtues of Mixing Tandem and Cascade Coupler Connections", Radiation Systems, Inc., May 17, 1971, 2 pages.
J. Paul Shelton, "Tandem Couplers and Phase Shifters for Multi-Octave Bandwidth", Microwaves, Radiation Systems, Inc., Apr. 1, 1965, 6 pages.
H.J. Hindin et al., "3-dB Couplers Constructed from Two Tandem Connected 8.34-dB Asymmetric Couplers", IEEE Transactions on Microwave Theory and Techniques, Feb. 1968, 2 pages.
Lewis Steer, "A Compact High Power UHF Combiner for Multiple Channels Over a Wide Frequency Span", NAB Broadcast Engineering Conference Proceedings, Apr. 21, 2001, 6 pages.

* cited by examiner

DIRECTIONAL COUPLER

BACKGROUND

Field of the Disclosure

The present disclosure relates generally to wireless communication and, more particularly, to directional couplers used in wireless communication.

Description of the Related Art

A directional coupler is a passive device that couples a defined amount of electromagnetic power applied to an input port from a transmission line to an output port in one direction. Directional couplers may be used as power splitters that divide the power received at an input port into portions provided to two or more output ports. They may also be used (in the reverse direction) as power combiners that combine the power received at two or more input ports and provide the combined power to an output port. The most common form of a directional coupler is implemented as a pair of coupled transmission lines that have ports at both ends of a main transmission line and a port at one end of a coupled transmission line. The port at the other end of the coupled transmission line is isolated and receives no power. A transverse electromagnetic (TEM) mode directional coupler can be implemented using two overlying striplines that are positioned proximate to each other. The linear dimension of the coupled portion of the striplines is approximately $\lambda/4$, where $\lambda$ is the wavelength corresponding to the center frequency of the TEM-mode directional coupler. The striplines are positioned within a cavity to form a quasi-coaxial configuration of the inner stripline and the outer cavity.

Large surface current densities on the striplines in TEM-mode directional couplers can generate high temperatures in the striplines, particularly when the TEM-mode directional coupler is used at powers above hundreds of Watts and depending on the cross section of the striplines. The maximum average power rating for the directional coupler may therefore be limited by the ability of the striplines to dissipate heat. For example, the stripline may oxidize when the temperature of the stripline exceeds an oxidation threshold, which may in turn increase the rate of heat dissipation in the stripline and potentially lead to thermal runaway and failure of the directional coupler when operated above a threshold transmission power. Conventional TEM-mode directional couplers dissipate the heat generated by the surface currents via three modes: (1) conduction through the air that separates the inner stripline from the outer cavity and from the coupler to coaxial lines attached to the coupler, (2) radiation from the surfaces of the striplines, and (3) convection in the air surrounding the inner stripline. The three modes of heat dissipation are limited by the structure of the directional coupler, which determines the volume of air available for conduction or convection and the stripline surface area available for radiation. The average power rating of the directional coupler may be increased by increasing the dimensions of the device, but increasing the dimensions degrades the electrical performance of the TEM-mode directional coupler, if a certain cross-sectional size is exceeded.

SUMMARY OF EMBODIMENTS

The following presents a summary of the disclosed subject matter in order to provide a basic understanding of some aspects of the disclosed subject matter. This summary is not an exhaustive overview of the disclosed subject matter. It is not intended to identify key or critical elements of the disclosed subject matter or to delineate the scope of the disclosed subject matter. Its sole purpose is to present some concepts in a simplified form as a prelude to the more detailed description that is given later.

In some embodiments, an apparatus is provided that includes a directional coupler. The apparatus includes an outer cavity and first and second striplines deployed within the outer cavity such that signals propagating in a transverse electromagnetic (TEM) mode are coupled between first portions of the first stripline and the second stripline. The directional coupler also includes first and second electrically and thermally conductive elements connecting the first and second striplines, respectively, to the outer cavity.

In some embodiments, an apparatus is provided that includes a directional coupler. The apparatus includes a first U-shaped stripline formed of a base and two arms and a second U-shaped stripline formed of a base and two arms. The first and second U-shaped striplines are deployed in an overlay configuration so that signals propagating in a transverse electromagnetic (TEM) mode are coupled between the two arms of the first and second U-shaped striplines. The base of the first U-shaped stripline is opposite the base of the second U-shaped stripline. The apparatus also includes first and second electrically and thermally conductive elements connecting the first and second striplines, respectively, to an outer cavity that encompasses the first and second U-shaped striplines.

In some embodiments, an apparatus is provided that includes first and second directional couplers. Each directional coupler includes an outer cavity and first and second striplines deployed within the outer cavity such that transverse electromagnetic (TEM) mode signals are coupled between first portions of the first stripline and the second stripline. Each directional coupler also includes first and second electrically and thermally conductive elements connecting the first and second striplines, respectively, to the outer cavity. The apparatus also includes a first bandpass filter connected between a first output port of the first directional coupler and a first input port of the second directional coupler and a second bandpass filter coupled between a second output port of the first directional coupler and a second input port of the second directional coupler.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

The rate of heat dissipation from a pair of striplines in a TEM-mode directional coupler may be increased without degrading its electrical performance by connecting each stripline at a suitable location to the outer cavity using a metal element (or stub) that is electrically and thermally conductive. The length of the stubs is equal to λ/4, where λ is the wavelength corresponding to the center frequency of the TEM-mode directional coupler. Each stub is connected to a section of the corresponding stripline that has a lower impedance than a port impedance of the coupler. Some embodiments of the TEM-mode directional coupler may also include compensation rings deployed between the stubs and the low impedance sections of the striplines. The stubs are electrically transparent to electromagnetic waves within a certain bandwidth around a wavelength of λ. The low impedance section modifies the reflection coefficient of the stub section within the TEM-mode directional coupler around the central wavelength λ so that the stub section of the TEM-mode directional coupler is transparent over a very much larger bandwidth (relative to a TEM-mode directional coupler that does not include a low impedance section and only includes a stub) such as a bandwidth from 470 MHz to 700 MHz in the radiofrequency range of ultra-high frequency (UHF) radio communication. The improved rate of heat dissipation can significantly increase the power handling capability of the TEM-mode directional coupler by lowering the stripline temperature. For example, the power handling capability of some embodiments of TEM-mode directional couplers that include the conductive stubs and low impedance sections may be increased by 25-30% relative to conventional TEM-mode directional couplers because the stub conducts heat away from the inner conductors to the outer body and thereby reduces the inner temperatures.

Figure 1A:
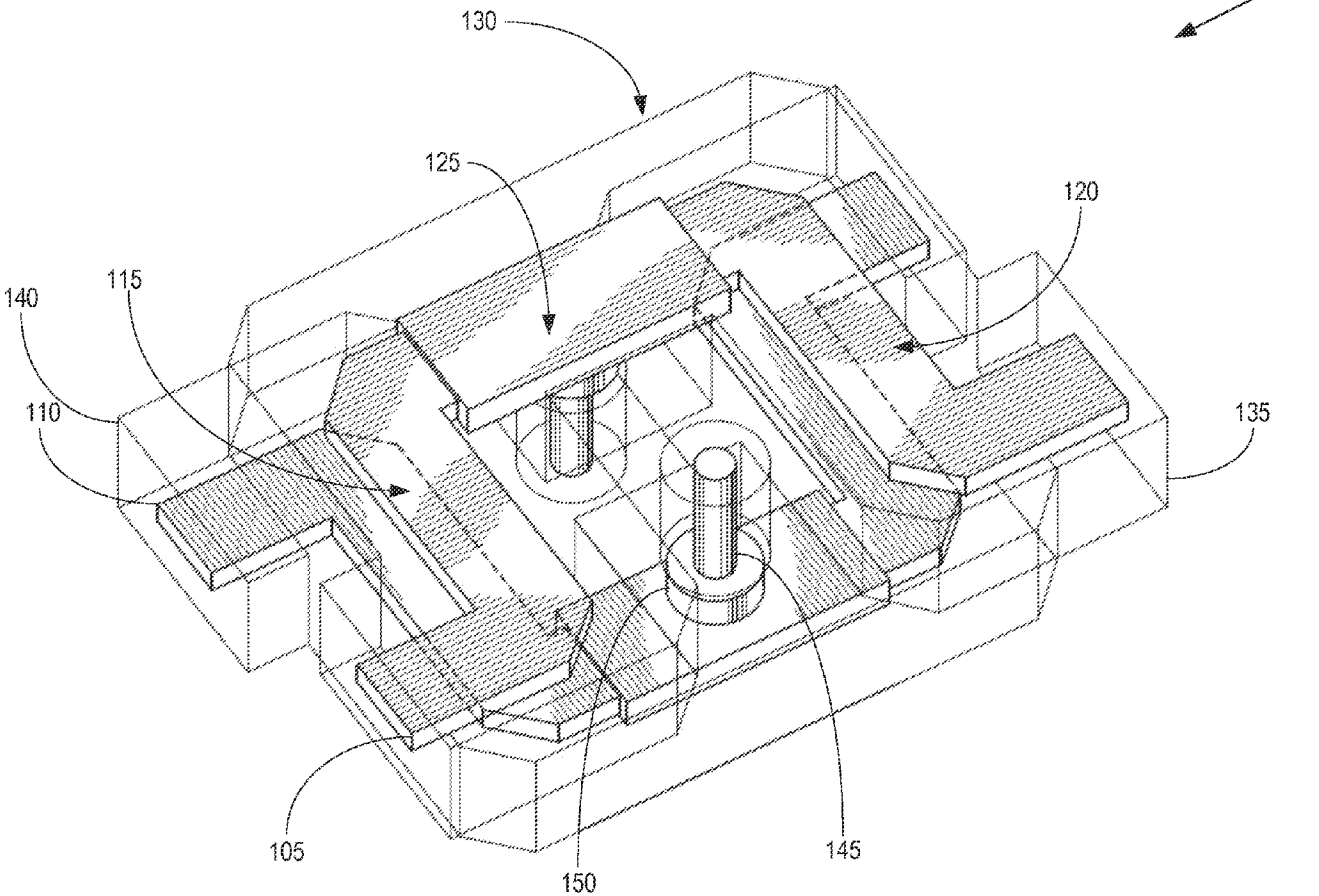
FIG. 1A is a perspective drawing of a directional coupler including compensating rings according to some embodiments.

FIG. 1A is a perspective drawing of a directional coupler 100 according to some embodiments. The directional coupler 100 includes striplines 105, 110 that are overlaid with each other so that transverse electromagnetic (TEM) modes of signals propagating in portions of the striplines 105, 110 coupled to each other. For example, the striplines 105, 110 may be U-shaped striplines that are formed of arms 115, 120 and a base 125. In the interest of clarity, the arms and the base of the stripline 110 are not indicated by reference numerals. The striplines 105, 110 are deployed in an overlay configuration. The striplines 105, 110 are deployed within the volume of an outer cavity 130 so that surrounding space separates the striplines 105, 110 from the outer cavity 130. The surrounding space may be a vacuum or it may be filled with another material such as air or another gas, liquid, or solid dielectric material. Some embodiments of the outer cavity 130 include a first portion 135 that encompasses the stripline 105 and a second portion 140 that encompasses the stripline 110. The striplines 105, 110 or the portions 135, 140 may be formed out of an electrically and thermally conductive material such as copper.

A portion of a TEM-mode of a signal propagating in the arms 115, 120 of the stripline 105 may be coupled into the corresponding arms of the stripline 110. The degree of coupling may be determined by a separation between the striplines 105, 110, as well as other parameters of the directional coupler 100 such as the cross-sectional dimensions of the striplines and the outer cavity, 120. The arms 115, 120 (and the corresponding arms in the stripline 110) may have lengths equal to λ/4, where λ is a wavelength corresponding to a center frequency of the directional coupler 100 for TEM-mode signals. The coupling strength between the arm 115 of the stripline 105 and the corresponding arm of the stripline 110 may be 8.34 dB and the coupling strength between the arm 120 of the stripline 105 and the corresponding arm of the stripline 110 may be 8.34 dB. The net coupling strength of the directional coupler 100 may therefore be 3 dB.

Conductive elements 145 (which may also be referred to as shunt stubs) are connected to the arms 115, 120 and to the outer cavity 130. In the interest of clarity, the reference numeral for the conductive element connected to the arm 120 is not shown. For example, the conductive element 145 is connected to the base of the stripline 110 and to the outer cavity 130. The conductive element 145 therefore provides an electrically and thermally conducting path between the arms 115, 120 and the outer cavity 130. In the illustrated embodiment, the directional coupler 100 includes a compensating ring 150 (only one indicated by a reference numeral in the interest of clarity) that is connected to the conductive element 145 and the base of the stripline 110. The relative impedances of the base and arms of the striplines 105, 110 are determined to render the combination of the stub 145, base 125, and compensating ring 150 substantially electrically transparent within a bandwidth around the central wavelength λ of the directional coupler 100. As used herein, the term "substantially" is used to indicate that the combination is electrically transparent within a certain tolerance, which may be measured in decibels. For example, the impedance of the base 125 may be lower than the impedances of the arms 115, 120 so that a return loss of the base 125 and the conductive element 145 is less than a threshold value over a bandwidth extending from 470 MHz to 700 MHz. The threshold value may be in the range −30 dB to −50 dB.

Figure 1B:
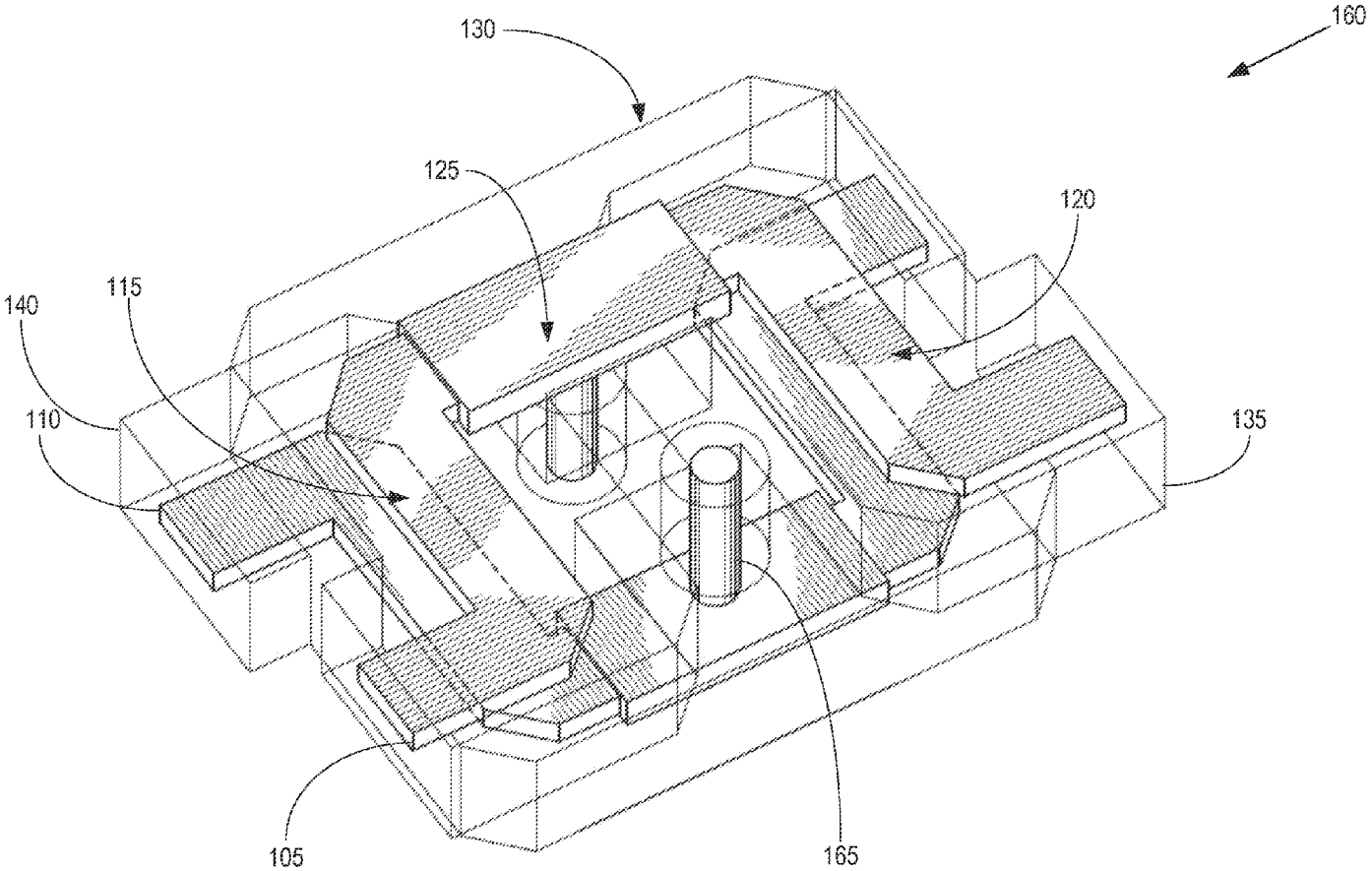
FIG. 1B is a perspective drawing of a directional coupler that does not include a compensating ring according to some embodiments.

FIG. 1B is a perspective drawing of a directional coupler 160 according to some embodiments. Elements of the embodiment of the directional coupler 160 shown in FIG. 1B that correspond to elements of the embodiment of the directional coupler 100 shown in FIG. 1A are indicated by the same reference numerals. The embodiment of the directional coupler 160 shown in FIG. 1B differs from the embodiment of the directional coupler 100 shown in FIG. 1A because the directional coupler 160 does not include the compensating rings 150 that are part of the directional coupler 100. The directional coupler 160 also differs from the directional coupler 100 because the diameter of the stub 160 is larger than the diameter of the stub 145 in the directional coupler 100. The relative impedances of the base and arms of the striplines 105, 110 are determined to render the combination of the stub 165 and the base 125 substantially electrically transparent within a bandwidth around the central wavelength λ of the directional coupler 160. For example, the impedance of the base 125 may be lower than the impedances of the arms 115, 120 so that a theoretical return loss of the section including the base 125 and the conductive element 145 is less than −50 dB over a bandwidth extending from 470 MHz to 700 MHz.

Figure 2:
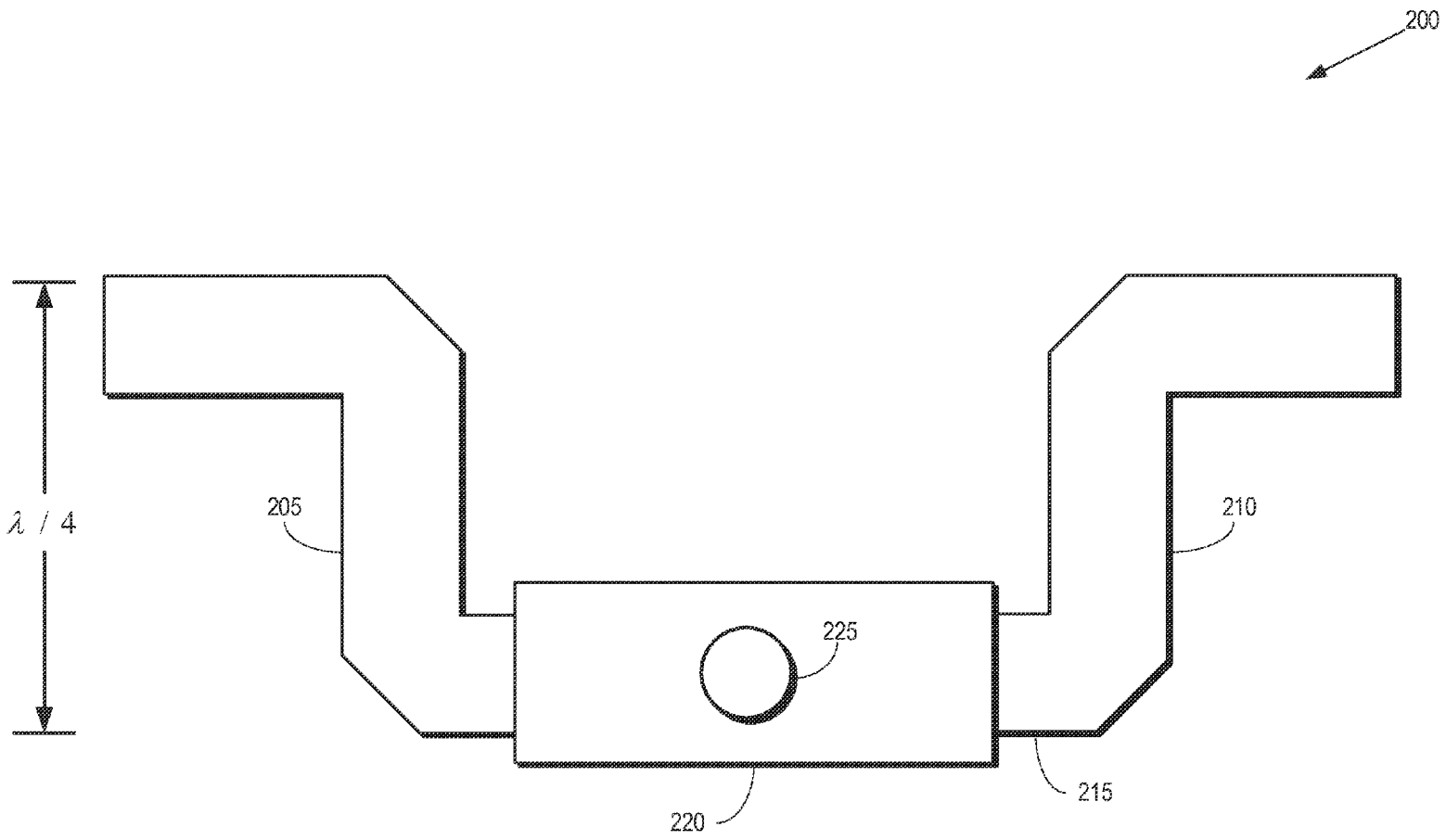
FIG. 2 is a top-down view of a stripline that may be incorporated in a directional coupler according to some embodiments.

FIG. 2 is a top-down view of a stripline 200 that may be incorporated in a directional coupler according to some embodiments. The stripline 200 may be used to implement some embodiments of the striplines 105, 110 shown in FIGS. 1A and 1B. The stripline 200 is a U-shaped stripline formed of arms 205, 210 and a base 215 that includes a low impedance section 220. A stub 225 is connected to the low impedance section 220. The impedance of the low impedance section 220 is lower than a port impedance of the directional coupler including the stripline 200 so that the section including stub 225 and the low impedance section 220 are substantially electrically transparent within a bandwidth around the central wavelength λ of a TEM-mode of the stripline 200. The arms 205, 210 have lengths that are substantially equal to λ/4.

Figure 3:
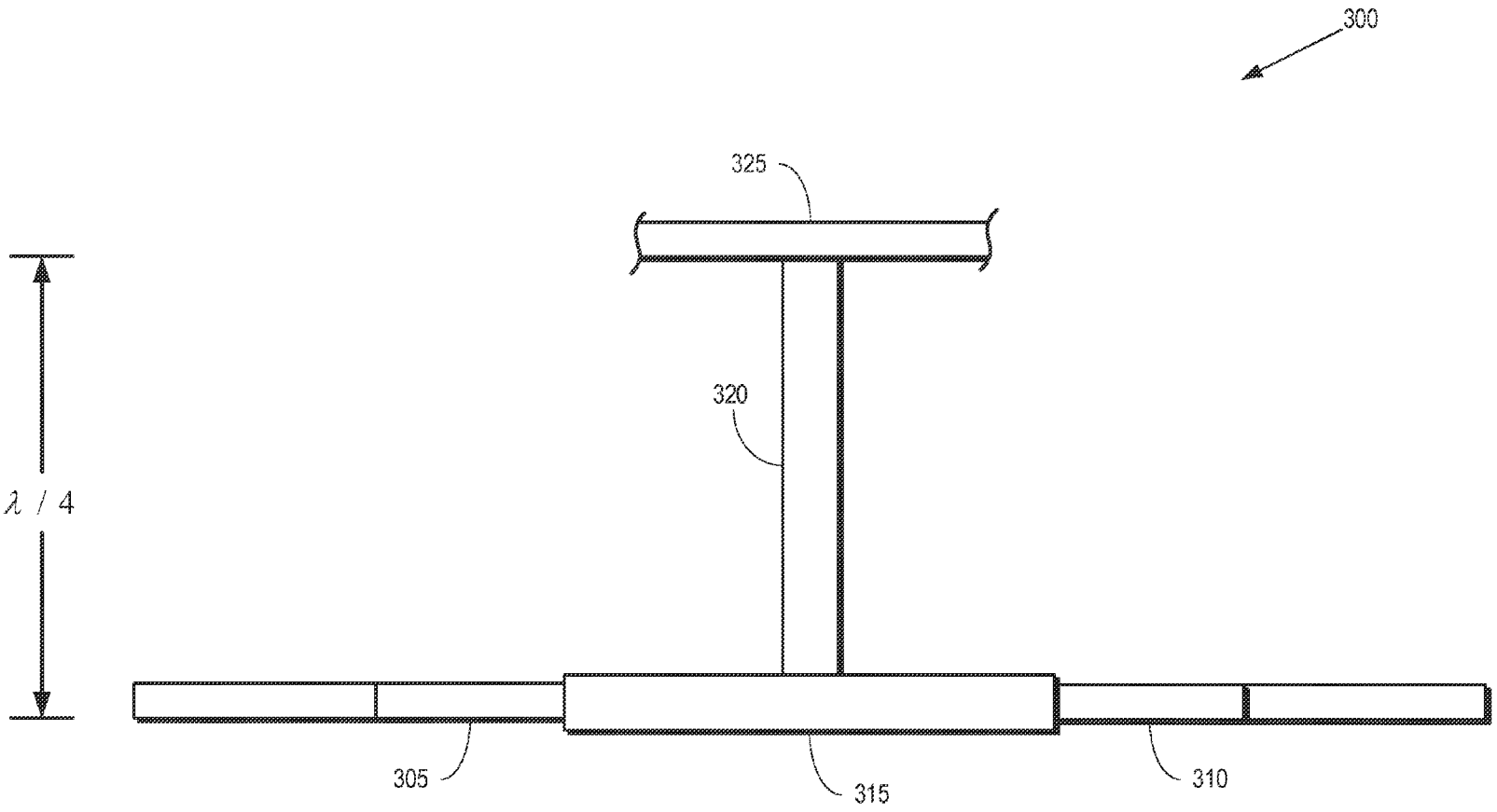
FIG. 3 is a side view of a portion of a directional coupler according to some embodiments.

FIG. 3 is a side view of a portion 300 of a directional coupler according to some embodiments. The portion 300 of the directional coupler may be used to implement some embodiments of the directional coupler 100 shown in FIG. 1A (if a compensating ring is included) or the directional coupler 160 shown in FIG. 1B (if no compensating ring is included). The portion 300 of the directional coupler includes a stripline that is formed of arms 305, 310 and a base that includes a low impedance section 315. A stub 320 is connected to the low impedance section 315 and then outer cavity 325 of the directional coupler, such as the outer cavity 130 shown in FIGS. 1A and 1B. The impedance of the low impedance section 315 is lower than a port impedance of the directional coupler. The stub 320 has a length that is substantially equal to λ/4. The term "substantially equal" will be understood to indicate that the length of the stub 320 is equal to λ/4 within a tolerance that may be determined based on a target degree of electrical transparency of the stub 320. The combination of the low impedance section 315 and the stub 320 is substantially electrically transparent within a bandwidth around the central wavelength λ of a TEM-mode of the directional coupler, at least in part because of the relatively low impedance of the low impedance section 315 and the length of the stub 320.

Figure 4:
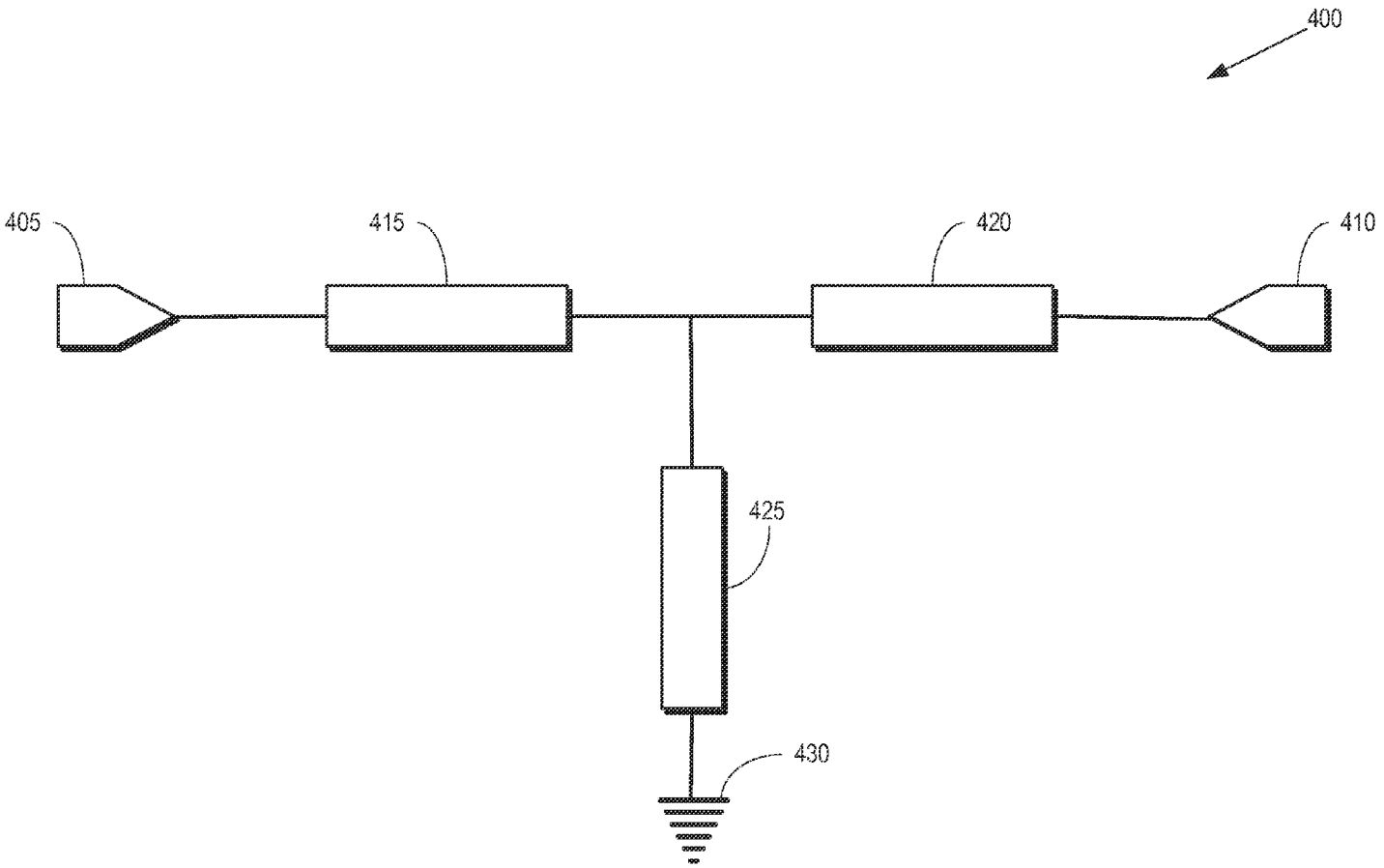
FIG. 4 is a diagram of an equivalent circuit corresponding to low impedance sections of a stripline that are connected to a stub according to some embodiments.

FIG. 4 is a diagram of an equivalent circuit 400 corresponding to a section of a stripline including a low impedance section to which a stub is connected according to some embodiments. Some embodiments of the equivalent circuit 400 may be representative of the striplines 105, 110 shown in FIG. 1A or 1B, the stripline 200 shown in FIG. 2, or the stripline shown in FIG. 3. The equivalent circuit 400 includes ports 405, 410. In some embodiments, the ports 405, 410 represent interfaces to and from the low-impedance section to which the stub is connected and may be referred to as an input port or an output port depending on the implementation of the equivalent circuit 400. The ports 405, 410 have a first port impedance that may correspond to the impedance of arms of the stripline. The ports 405, 410 are connected to corresponding portions 415, 420 of the low impedance section of the stripline. The portions 415, 420 have a second port impedance that is lower than the first impedance. The equivalent circuit 400 also includes a stub 425 that is connected between the portions 415, 420 of the stripline and electrical ground 430. The stub 425 may have a third impedance that is higher or lower than the first impedance.

Figure 5:
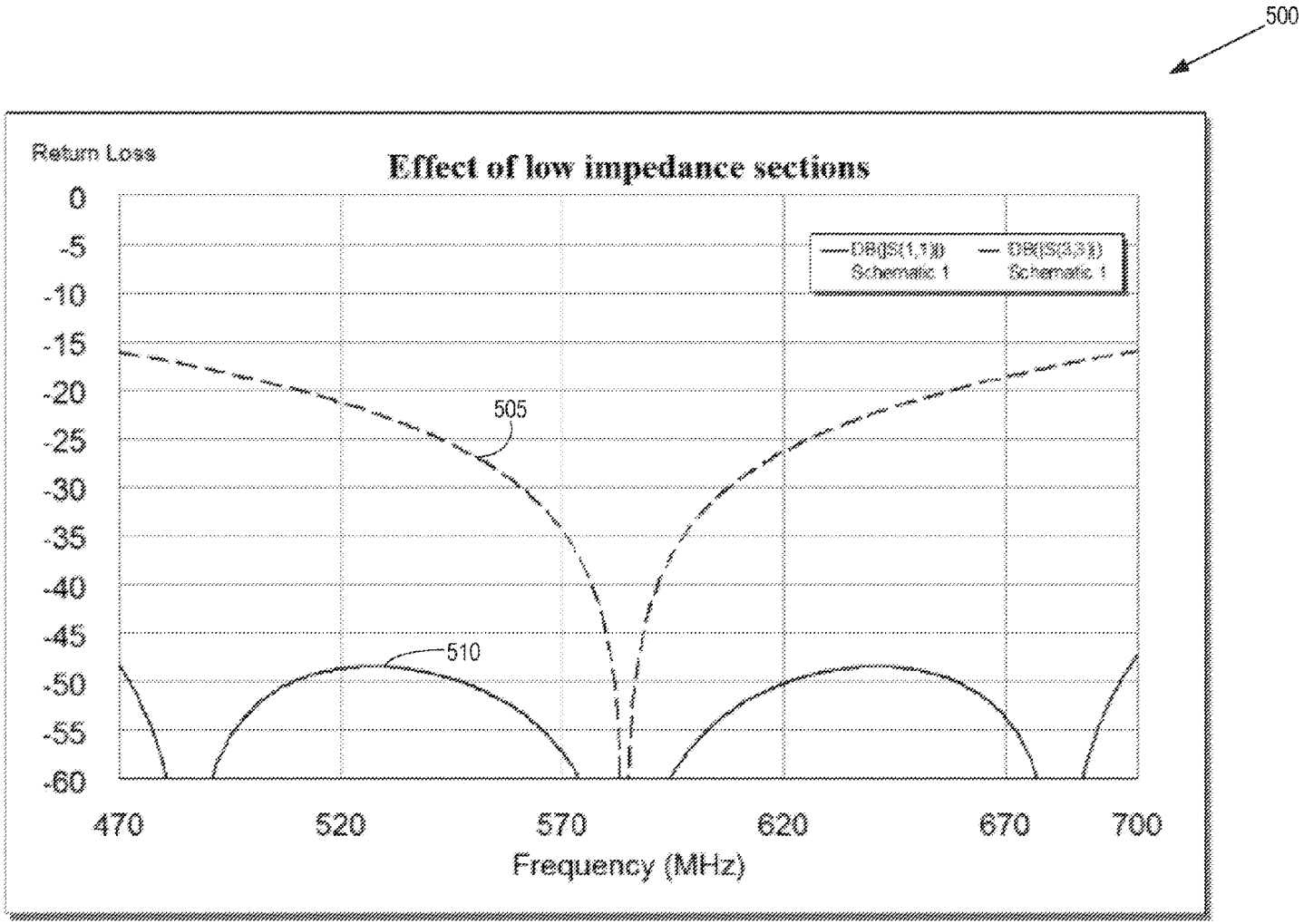
FIG. 5 is a plot of the return loss response of the equivalent circuit shown in FIG. 4 according to some embodiments.

FIG. 5 is a plot 500 of the return loss of a portion of a stripline that includes a stub according to some embodiments. The horizontal axis indicates the frequency in megahertz (MHz) and the vertical axis indicates a reflectivity or return loss in decibels. The dashed line 505 indicates the return loss for a stub (such as the conductive element 145 shown in FIG. 1A) connected to a stripline that does not include a low impedance section so that the impedance of the stripline is substantially constant across the entire length of the stripline. The return loss 505 is less than a threshold value (e.g. a threshold value in the range −30 dB to −50 dB) in a narrow bandwidth of a few megahertz around a central frequency of approximately 585 MHz. The solid line 510 indicates the return loss for a section where a stub is connected to a low impedance section in a stripline (such as the base 125 in the stripline 105 shown in FIGS. 1A and 1B). Including the low impedance section expands the bandwidth so that the return loss 510 is less than or on the order of the threshold value in a larger bandwidth of 230 MHz around a central frequency of approximately 585 MHz.

Figure 6:
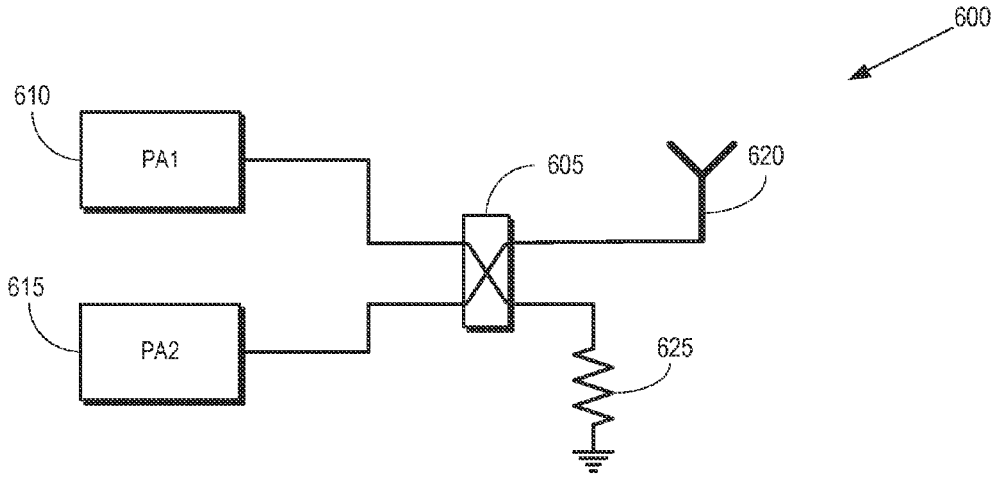
FIG. 6 is a block diagram of a power combiner according to some embodiments.

FIG. 6 is a block diagram of a power combiner 600 according to some embodiments. The power combiner 600 includes a directional coupler 605 such as the directional coupler 100 shown in FIG. 1A for the directional coupler 160 shown FIG. 1B. The power combiner 600 also includes a transmitter's two power amplifiers 610, 615 that are coupled to respective input ports of the directional coupler 605. One output port of the directional coupler 605 is coupled to an antenna 620 for transmitting the combined signals provided by the transmitters 610, 615. The other output port of the directional coupler 605 is coupled to a balancing load represented by the resistor 625. The phase of the signal emitted from the first power amplifier 610 is adjusted to be 90° out of phase to the signal emitted from the second power amplifier 615. The power combiner 600 may also be referred to as a "quadrature hybrid power combiner" or a "90° hybrid power combiner."

Figure 7:
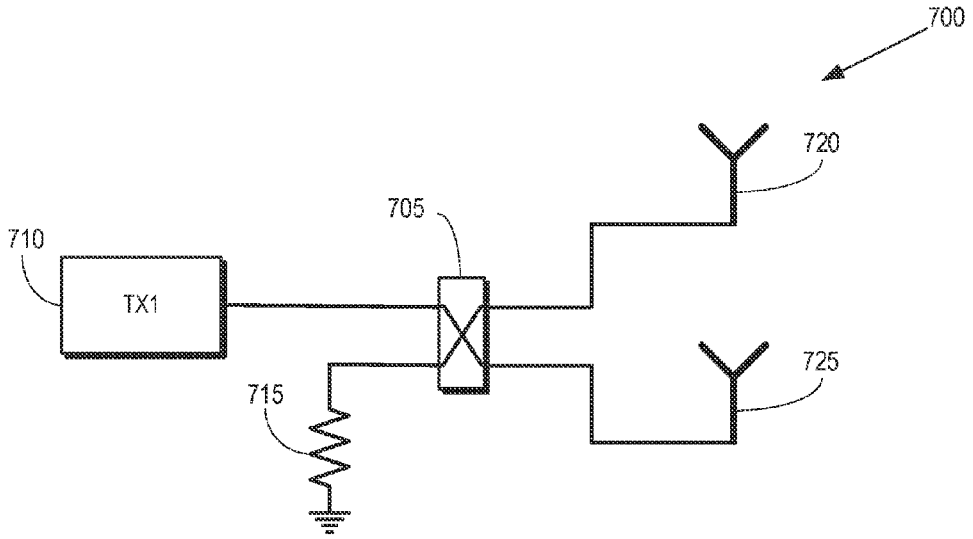
FIG. 7 is a block diagram of a power splitter according to some embodiments.

FIG. 7 is a block diagram of a power splitter 700 according to some embodiments. The power splitter 700 includes a directional coupler 705 such as the directional coupler 100 shown in FIG. 1A or the directional coupler 160 shown in FIG. 1B. The power splitter 700 also includes a transmitter 710 that is coupled to an input port of the directional coupler 705. The other output port of the directional coupler 705 is coupled to a balancing load represented by the resistor 715. The output ports of the directional coupler 705 are coupled to antennas 720, 725, respectively, so that a first portion of the power generated by the transmitter 710 is provided to the first antenna 720 and a second portion of the power generated by the transmitter 710 is provided to the second antenna 725. In some embodiments, the phase of the signal output by the first output port of the directional coupler 705 may be adjusted to be 90° out of phase to the signal emitted from second output port of the directional coupler 705. The power splitter 700 may also be referred to as a "quadrature hybrid power splitter" or a "90° hybrid power splitter."

Figure 8:
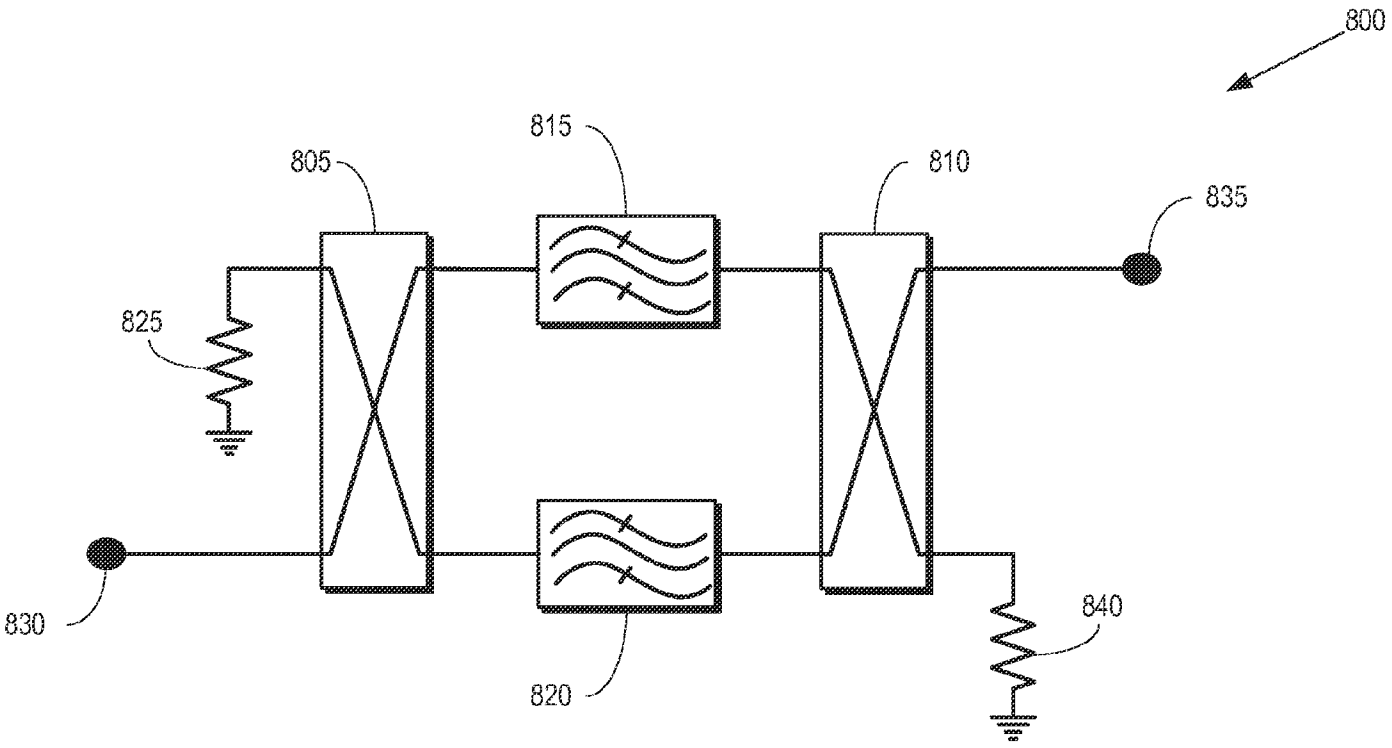
FIG. 8 is a block diagram of a balanced combiner module according to some embodiments.

FIG. 8 is a block diagram of a filter module 800 according to some embodiments. The filter module 800 includes two directional couplers 805, 810 that may be implemented using embodiments of the directional coupler 100 shown in FIG. 1A or the directional coupler 160 shown in FIG. 1B. The filter module 800 also includes two bandpass filters 815, 820, which may filter radiofrequency signals within the same bandwidth or passband. The bandpass filters 815, 820 are coupled between two output ports of the directional coupler 805 and two input ports of the directional coupler 810, respectively. A first input port of the directional coupler 805 is coupled to a balancing load 825 and a second input port of the directional coupler 805 is coupled to a node 830. A first output port of the directional coupler 810 is coupled to a node 835 and a second output port of the directional coupler 810 is coupled to a balancing load 840.

Some embodiments of the filter module 800 may be used to increase the power handling capability of the filter modulate 800. For example, dividing the signal using the directional coupler 805 so that portions of the signal can be filtered separately in the filters 815, 820 may effectively double the power handling capability of the filter module 800 relative to the power handling capability of a single filter such as the filters 815, 820. Some embodiments of the filter module 800 may be used to provide a wideband impedance match to one or more devices connected to the nodes 830, 835. The filter module 800 may therefore be referred to as a "constant impedance filter (CIF)" or a "balanced filter module." Some embodiments of the filter module 800 may be used in a multiplicity to combine two transmitters of different frequencies together, in which case the filter module 800 may be referred to as a "balanced combiner module" or a "constant impedance combiner module." When used in this manner, the resistor 840 is replaced by a wideband input port that receives the preceding channel signals.

Embodiments of the directional coupler described herein may have a number of advantages over conventional directional couplers. For example, the volume of the directional coupler may be reduced because of the increased power dissipation rate provided by connecting the outer body to the stubs and low impedance sections of the striplines described herein. For another example, the low impedance sections increase the bandwidth of embodiments of the directional couplers described herein. In some cases, the bandwidth of the directional coupler may extend over the full UHF television operating frequency range. Together, the increased power dissipation rate and extended bandwidth make embodiments of the directional couplers described herein highly advantageous for implementation as external connectors to high power television transmitters.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. An apparatus comprising:

a cavity;

first and second striplines deployed within the cavity such that transverse electromagnetic (TEM) mode signals are coupled between first portions of the first stripline and the second stripline; and first and second electrically and thermally conductive elements connecting the first and second striplines, respectively, to the cavity, wherein the first and second electrically and thermally conductive elements are connected to second portions of the first and second striplines, respectively, and wherein the second portions of the first and second striplines have a lower impedance than a port impedance.

2. The apparatus of claim 1, wherein the first portions of the first stripline and the second stripline have lengths that are substantially equal to $\lambda/4$, where $\lambda$ is a wavelength corresponding to a center frequency of the apparatus for TEM-mode signals.

3. The apparatus of claim 2, wherein the first and second electrically and thermally conductive elements have lengths equal to $\lambda/4$.

4. The apparatus of claim 1, wherein the first and second electrically and thermally conductive elements and the second portions of the first and second striplines are substantially electrically transparent to electromagnetic waves within a bandwidth around a wavelength of $\lambda$.

5. The apparatus of claim 4, wherein the bandwidth is in a range from 470 MHz to 700 MHz.

6. The apparatus of claim 1, wherein the first and second conductive elements are coupled to the second portions of the first and second striplines by first and second compensating rings, respectively.

7. The apparatus of claim 1, wherein the cavity comprises first and second outer cavities that encompass the first and second striplines, respectively.

8. The apparatus of claim 1, further comprising:

first and second power amplifiers coupled to input ports;

an antenna coupled to an output port; and a resistive load connected to an output port.

9. The apparatus of claim 1, further comprising:

a transmitter coupled to an input port;

a resistive load connected to an input port; and first and second antennas coupled to output ports, respectively.

10. An apparatus comprising:

a first U-shaped stripline comprising a base and two arms;

a second U-shaped stripline comprising a base and two arms, wherein the first and second U-shaped striplines are deployed in an overlay configuration so that coupling of transverse electromagnetic (TEM) mode signals exists between the two arms of the first and second U-shaped striplines, and wherein the base of the first U-shaped stripline is opposite the base of the second U-shaped stripline, wherein the bases of the first and second U-shaped striplines have a lower impedance than a port impedance of the apparatus; and first and second electrically and thermally conductive elements connecting the first and second striplines, respectively, to an outer cavity that encompasses the first and second U-shaped striplines.

11. The apparatus of claim 10, wherein portions of the arms of the first and second U-shaped striplines have lengths equal to $\lambda/4$, where $\lambda$ is a wavelength corresponding to a center frequency of the apparatus for TEM-mode signals.

12. The apparatus of claim 11, wherein the first and second electrically and thermally conductive elements have lengths equal to $\lambda/4$.

13. The apparatus of claim 10, wherein the first and second conductive elements and the bases of the first and second U-shaped striplines are substantially electrically transparent to electromagnetic waves within a bandwidth around a wavelength of λ.

14. The apparatus of claim 13, wherein the bandwidth is in a range from 470 MHz to 700 MHz.

15. The apparatus of claim 10, wherein the first and second electrically and thermally conductive elements are connected to the bases of the first and second U-shaped striplines via first and second compensating rings, respectively.

16. The apparatus of claim 10, wherein the outer cavity comprises first and second outer thermally conductive elements that encompass the first and second U-shaped striplines, respectively.

17. An apparatus comprising:

first and second directional couplers, wherein each directional coupler comprises:

an outer cavity;

first and second striplines deployed within the outer cavity such that transverse electromagnetic (TEM) mode signals are coupled between first portions of the first stripline and the second stripline; and first and second electrically and thermally conductive elements connecting the first and second striplines, respectively, to the outer cavity, wherein the first and second electrically and thermally conductive elements are connected to second portions of the first and second striplines, respectively, and wherein the second portions of the first and second striplines have a lower impedance than a port impedance;

a first bandpass filter coupled between a first output port of the first directional coupler and a first input port of the second directional coupler; and a second bandpass filter coupled between a second output port of the first directional coupler and a second input port of the second directional coupler.

18. The apparatus of claim 17, wherein the first portions of the first stripline and the second stripline have lengths equal to λ/4, where λ is a wavelength corresponding to a center frequency of the apparatus for TEM-mode signals, wherein the first and second electrically and thermally conductive elements have lengths equal to λ/4.

* * * * *